US007657952B2

(12) United States Patent
Hutchison

(10) Patent No.: US 7,657,952 B2
(45) Date of Patent: Feb. 9, 2010

(54) SUPPLEMENTAL EXERCISE MAT

(76) Inventor: Gail J. Hutchison, 1583 Corner Pl., Hoffman Estates, IL (US) 60169

( * ) Notice: Subject to any disclaimer, the term of this patent is extended or adjusted under 35 U.S.C. 154(b) by 191 days.

(21) Appl. No.: 12/020,274

(22) Filed: Jan. 25, 2008

(65) Prior Publication Data

US 2008/0229501 A1 Sep. 25, 2008

Related U.S. Application Data

(60) Provisional application No. 60/886,558, filed on Jan. 25, 2007.

(51) Int. Cl.
*A47G 9/06* (2006.01)

(52) U.S. Cl. ..... 5/420; 224/257; 482/23; 482/142

(58) Field of Classification Search ..... 5/417–420; 383/4; 482/142, 130, 23; 224/155, 257
See application file for complete search history.

(56) References Cited

U.S. PATENT DOCUMENTS

| | | | | |
|---|---|---|---|---|
| 4,905,990 | A * | 3/1990 | DeSantis | 482/23 |
| 5,265,292 | A * | 11/1993 | Underell | 5/419 |
| 6,578,217 | B1 * | 6/2003 | Roberson | 5/632 |
| 6,751,816 | B1 * | 6/2004 | Wechsler | 5/417 |
| 7,007,322 | B2 * | 3/2006 | Alane | 5/417 |
| 7,485,071 | B2 * | 2/2009 | Edwards | 482/23 |
| 2007/0173382 | A1 * | 7/2007 | Axelrod | 482/91 |
| 2007/0275827 | A1 * | 11/2007 | Glaser | 482/23 |

* cited by examiner

*Primary Examiner*—Alexander Grosz
(74) *Attorney, Agent, or Firm*—Eugene M. Cummings, P.C.

(57) ABSTRACT

Provided is a mat supplemental to an exercise mat including a cushion portion for assisting in execution and/or maintaining of a select body position (e.g., a stretch, yoga pose, or Pilates pose). The supplemental mat may include a strap detachable from the cushion portion. The strap may further assist in the execution and/or maintaining of a select body position (e.g., a stretch, yoga pose, or Pilates pose). The strap may further serve to secure the cushion portion to the traditional exercise mat, thereby causing the supplemental mat to also serve as a carrier for the traditional exercise mat.

10 Claims, 8 Drawing Sheets

FIGURE 6
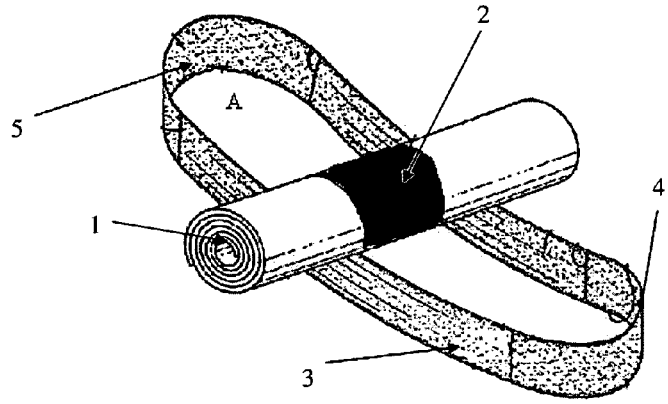
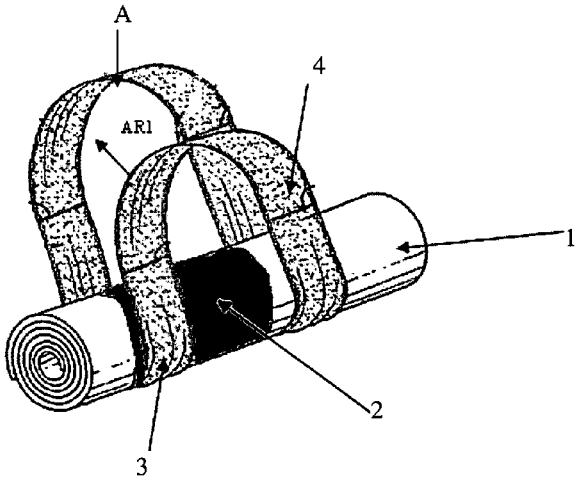
FIGURE 7
FIGURE 8
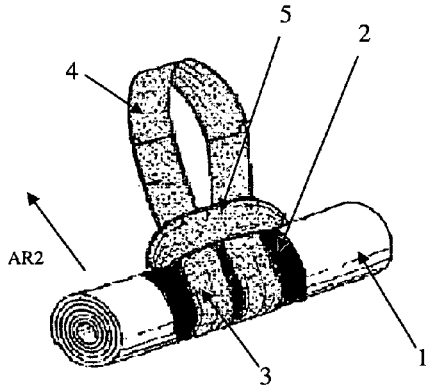

SUPPLEMENTAL EXERCISE MAT

CROSS-REFERENCE TO RELATED APPLICATIONS

This application claims benefit under 35 U.S.C. §119(e) of U.S. Provisional Application entitled "SUPPLEMENTAL EXERCISE MAT," filed on Jan. 25, 2007, having Ser. No. 60/886,558, naming Gail J. Hutchison as inventor, the complete disclosure thereof being incorporated by reference.

BACKGROUND OF THE INVENTION

The present invention generally relates to an article for use in connection with various types of exercise and activities, and more specifically, to a supplemental mat for optimizing an individual's position, safety, comfort and form when executing and/or maintaining a select body position (e.g., a stretch, yoga pose, or Pilates pose).

Yoga is a 5000-year old practice deeply rooted in the East. Yoga has increasingly gained popularity in the United States in the last 10 years. Its popularity stems from its ability to provide a mind and body workout. Yoga unites the mind and body through physical activity and breath. Yoga is the ability to execute and maintain a series of body poses. Although the body poses appear to be easy, some poses may be very difficult to achieve and maintain.

To achieve a given body pose, an individual practicing yoga must first learn the correct posture for the pose. Each yoga pose requires proper placement of the arms, legs, head, etc. Traditional yoga mats are relatively thin, sticky mats that facilitate an individual's comfort, balance and stability when executing and maintaining a pose. Nevertheless, even when using these traditional yoga mats, an individual may experience discomfort while learning and perfecting each pose. For example, some poses may be uncomfortable on the knees, shins, buttocks, head, and ankles when using a traditional mat. Accordingly, some individuals place a towel or blanket under certain body parts that may be tender or more sensitive to ease the discomfort. In other instances, an individual may also fold the yoga mat in an attempt to achieve more support or cushion in certain poses. However, towels generally do not provide enough cushion to alleviate the discomfort and thicker blankets tend to be too bulky and time consuming to fold to achieve maximum comfort. Moreover, doubling a traditional yoga mat only provides minor comfort and is problematic when trying to get from one pose to the next smoothly.

For example, one yoga pose (Lotus) requires the student to sit cross-legged and take the right foot and place it on top of the left thigh, with the sole facing upward then extending the left leg and folding it forward from the hips taking hold of the left ankle with the left hand placing the foot onto the right thigh. This is an advanced pose and many students must first try half Lotus (only placing one foot on top of the thigh) before going into full Lotus. Holding this pose for a period of time places great pressure and, in some cases, pain on the opposite ankle. Because yoga mats are usually thin, this pose can quickly become painful to maintain. Most beginning students can hold this pose for only a short duration of time. To assist the student in this pose (and other poses), a blanket is generally used to reduce the stress on the ankles and legs. Such blankets are helpful and may also be part of a typical yoga student's gear but they are not common and most students don not carry a blanket to class. Blankets also are cumbersome and do not provide enough cushion to reduce all discomfort.

Accordingly, it is an object of the present invention to provide a supplemental mat for optimizing an individual's position, safety, comfort and form when executing and/or maintaining a select body position (e.g., a stretch, yoga pose, or Pilates pose). It is further an object of the present invention to provide for a supplemental mat which may be utilized for smooth transition between body positions.

Another yoga pose (Boat) requires the student to extend the legs to an angle of 45 degrees from a seated position. Most beginning students can hold this pose for only a short duration of time. To assist the student to hold the pose, a nylon or cloth strap is commonly used to provide support. The strap is placed around the soles of the feet. The student then holds the two ends of the strap with his hands and raises the legs. By pulling on the end of the straps, the student supports the leg in the raised position. The strap is very helpful, and many yoga students have such straps as part of their yoga gear.

Accordingly, it is an object of the present invention to provide a supplemental mat including a strap which may be detached therefrom to assist in the execution and/or maintaining of a select body position (e.g., a stretch, yoga pose, or Pilates pose).

An individual may take a number of pieces of gear to exercise. For example, for yoga, she may take a yoga mat, a strap, a blanket, a towel, and a bag to carry such. The bag prevents the yoga mat from being unrolled during transit and when stored before and after class. Yoga bags are typically elongated pouch-like bags in which a rolled yoga mat is placed. Two disadvantages of such bags are that they do not allow the mat to breath and dry-out after class and they can be bulky. Taking all this gear to practice yoga, Pilates or other exercises can be cumbersome. While some of the gear may assist the student in maintaining a select body position, none of the gear can effectively ease discomfort of the body position while also being a carrier for the traditional exercise mat.

Accordingly, it is an object of the present invention to provide an article which serves as a carrier for a traditional exercise mat and may also be used as a supplemental mat for optimizing an individual's position, safety, comfort and form when executing and/or maintaining a select body position (e.g., a stretch, yoga pose, or Pilates pose). The supplemental mat may further include a detachable strap which may be used both as a carrier of exercise gear while also serving to assist in the execution and/or maintaining of a select body position (e.g., a stretch, yoga pose, or Pilates pose). This arrangement, which includes a supplemental mat and strap, effectively eliminates an individual's need to separately carry a traditional exercise mat, a blanket or towel, a strap, and a bag.

These and other desired benefits of the preferred embodiments, including combinations of features thereof, of the invention will become apparent from the following description. It will be understood, however, that a process or arrangement could still appropriate the claimed invention without accomplishing each and every one of these desired benefits, including those gleaned from the following description. The appended claims, not these desired benefits, define the subject matter of the invention. Any and all benefits are derived from the multiple embodiments of the invention, not necessarily the invention in general.

SUMMARY OF THE INVENTION

In accordance with the present invention, provided is a mat supplemental to an exercise mat including a cushion portion for assisting in execution and/or maintaining of a select body position (e.g., a stretch, yoga pose, or Pilates pose). The supplemental mat may include a strap detachable from the cushion portion. This strap may further assist in the execution and/or maintaining of a select body position (e.g., a stretch, yoga pose, or Pilates pose). The strap may further serve to secure the cushion portion to the exercise mat, thereby causing the supplemental mat to also serve as a carrier for the traditional exercise mat. In one embodiment, the supplemental mat includes a strap which secures the cushion portion about the rolled exercise mat. The exercise mat may be about 5 and one half feet long and 2 feet wide and the cushion portion of the supplemental mat may be about one quarter the size of the exercise mat. The supplemental mat may further be constructed of a flexible, wear-resistant material. Further provided is a three-in-one yoga kit, which comprises an exercise mat, a supplemental mat and a strap, each piece of which may be used during one's exercise/yoga practice.

It should be understood that the present invention includes a number of different aspects or features which may have utility alone and/or in combination with other aspects or features. Accordingly, this summary is not exhaustive identification of each such aspect or feature that is now or may hereafter be claimed, but represents an overview of certain aspects of the present invention to assist in understanding the more detailed description that follows. The scope of the invention is not limited to the specific embodiments described below, but is set forth in the claims now or hereafter filed.

BRIEF DESCRIPTION OF THE DRAWINGS

FIG. 6 is a perspective view of another strap for use with the present invention supplemental mat.

FIG. 7 is a perspective view of another strap for use with the present invention supplemental mat.

FIG. 8 is a perspective view of another strap for use with the present invention supplemental mat.

DETAILED DESCRIPTION OF THE INVENTION

Embodiments of the present invention relate to a supplemental mat, and more particularly to a mat supplement to a traditional exercise mat that optimizes an individual's position, safety, comfort and form while executing and maintaining a select body position (e.g., a stretch, yoga pose, or Pilates pose). The following description is presented to enable one of ordinary skill in the art to make and use the invention and is provided in the context of a patent application and its requirements. Various modifications to the preferred embodiment and the generic principles and features described herein will be readily apparent to those skilled in the art. Thus, the present invention is not intended to be limited to the embodiments shown, but is to be accorded the widest scope consistent with the principles and features described herein.

For example, although it is described as being used for yoga, the supplemental mat may be used as a supplemental mat for other exercises as well. For example, the supplemental mat may be used in Pilates or stretching to provide support and comfort while the individual executes and/or maintains a select body position. The exercise does not have to be a series of actions (such as a series of poses in yoga or Pilates), but may be a single action such as performing a single stretch.

In one embodiment, the present invention provides a supplemental mat 2 including a cushion portion for assisting in execution and/or maintaining of a yoga pose. The exercise mat 1 (e.g. traditional yoga mat) may be about 5 and a half inches long and 2 feet wide. The cushion portion of the supplemental mat 2 may be about one quarter the size of and thicker than a traditional yoga mat. The supplemental mat 2 may further be suitable for use over an exercise mat 1 (e.g. traditional yoga mat) to assist an individual with certain poses. Advantages of the present invention will now be described in detail with reference to the accompanying drawings.

Figure 1:
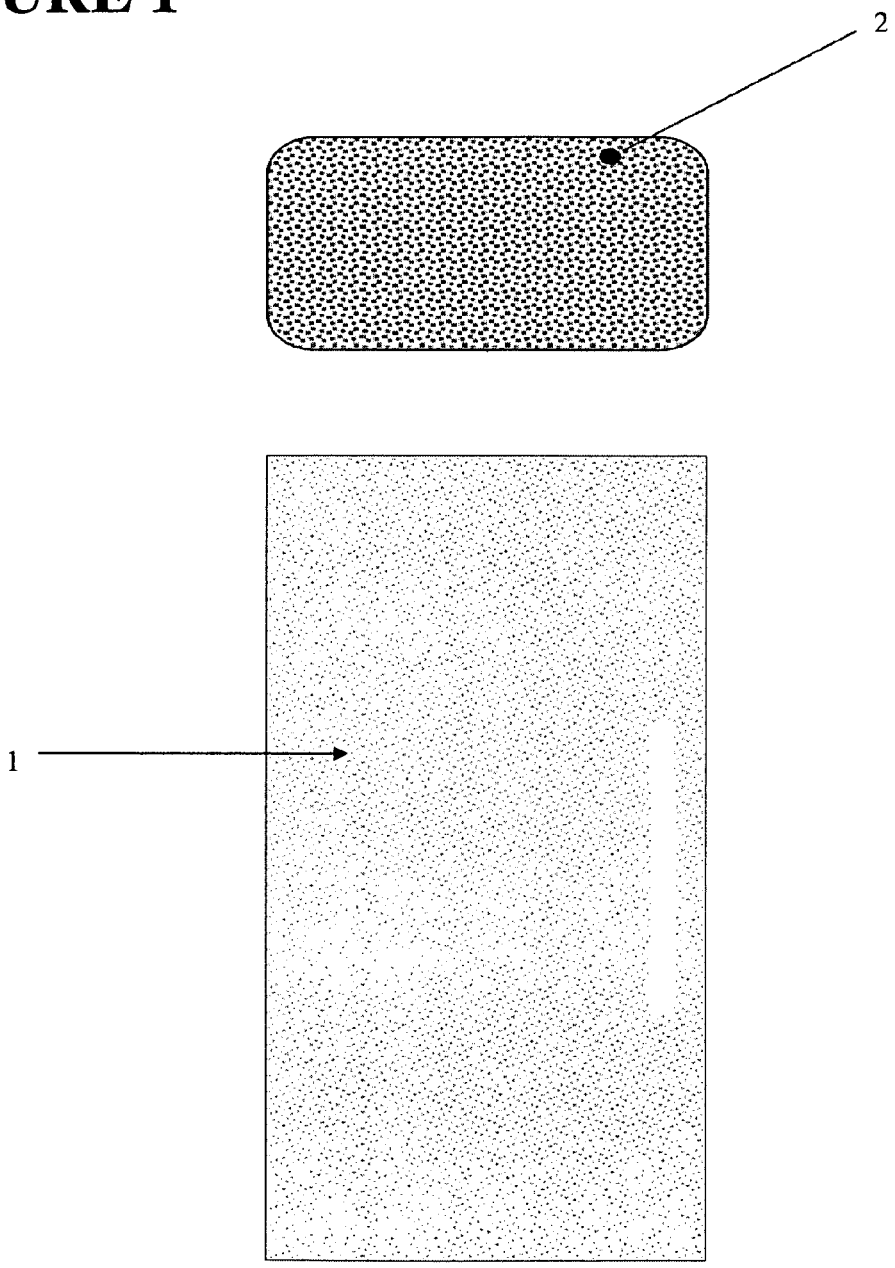
FIG. 1 is a top view of a first embodiment of a supplemental mat positioned in front of a traditional yoga mat showing the invention.
Figure 1A:
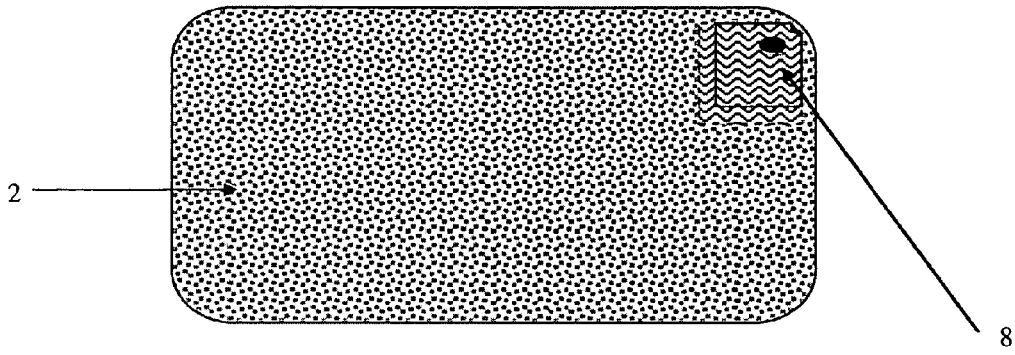
FIG. 1A is a top view of a second embodiment of a supplemental mat showing an aspect of the invention.
Figure 1B:
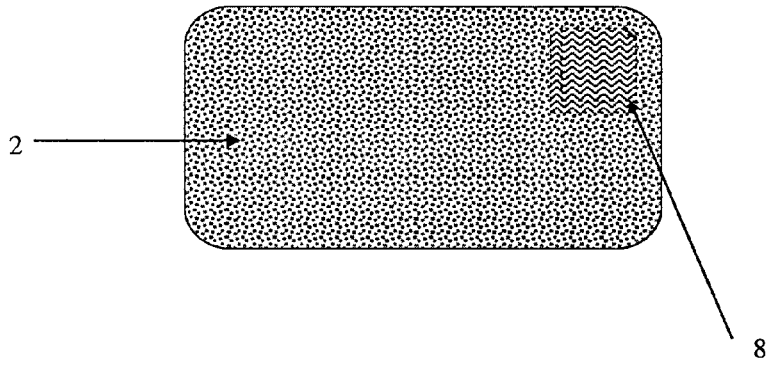
FIG. 1B is top view of a third embodiment of a supplemental mat showing an aspect of the invention.
Figure 1C:
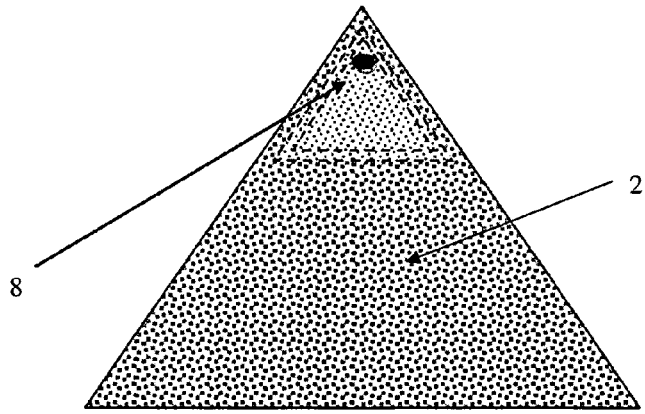
FIG. 1C is a top view of a fourth embodiment of a supplemental mat showing an aspect of the invention.

FIG. 1 is a top view of an exercise mat 1 (e.g. traditional yoga mat) with the supplemental mat 2 according to an embodiment of the present invention. The supplemental mat 2 includes a cushion portion for assisting in execution and/or maintenance of a stretch or yoga pose. The supplemental mat 2 may consist entirely of the cushion portion as shown in FIG. 1 or otherwise only a portion of the supplemental mat 2 may be a cushion portion (not shown). For example, supplemental mat 2 may further come in various sizes wherein the cushion portion is thicker than the remainder of the supplemental mat. The exercise mat 1 may be about 5 and one half inches long and 2 feet wide. The length of the supplemental mat 2 may further be sized to be approximately one quarter of the size of an exercise mat 1 (e.g. traditional yoga mat). In another embodiment, the supplemental mat 2 may be a square shape of about 2 feet long and 2 feet wide. In yet another embodiment, the supplemental mat may be a rectangular shape of about 4 feet long and 2 feet wide. In another embodiment as shown in FIGS. 1A-C, the supplemental mat 2 may further include a pocket 8. During use, an individual may easily place the supplemental mat 2 beneath a specific area of the body during poses while still getting the benefit of the exercise mat 1 (e.g. traditional yoga mat). Simultaneously, it optimizes the floor space that it occupies.

During exercise, an individual may perspire, resulting in his slipping off of the exercise mat 1 (e.g. traditional yoga mat). Accordingly, the present invention is directed towards preventing a user's sliding during his exercise. In one embodiment, the present invention supplemental mat 2 is constructed of a flexible, wear-resistant, slide-proof material. In another embodiment, both the top and bottom surfaces of the present invention supplemental mat 2 are treated so that when it is placed on a smooth surface, such as an exercise floor or on top of the exercise mat 1 (e.g. traditional yoga mat), the supplemental mat 2 stays in place (i.e., does not slide) and so that the user does not slide off of it. This embodiment is particularly well suited for performing Yoga poses and Pilates positions, which require precise positioning.

The supplemental mat 2 may also come in a variety colors including, but not limited to, purple, blue, orange, pink, green and yellow. The supplemental mat 2 can also have more than one color or design. For example, FIG. 1A shows a supplemental mat 2 according to an embodiment of the present invention with slightly rounded edges. FIG. 1B shows a supplemental mat 2 rounded according to an embodiment of the present invention with slight indentations in the center. FIG. 1C shows a supplemental mat 2 according to an embodiment of the present invention in a triangular shape.

Figure 2:
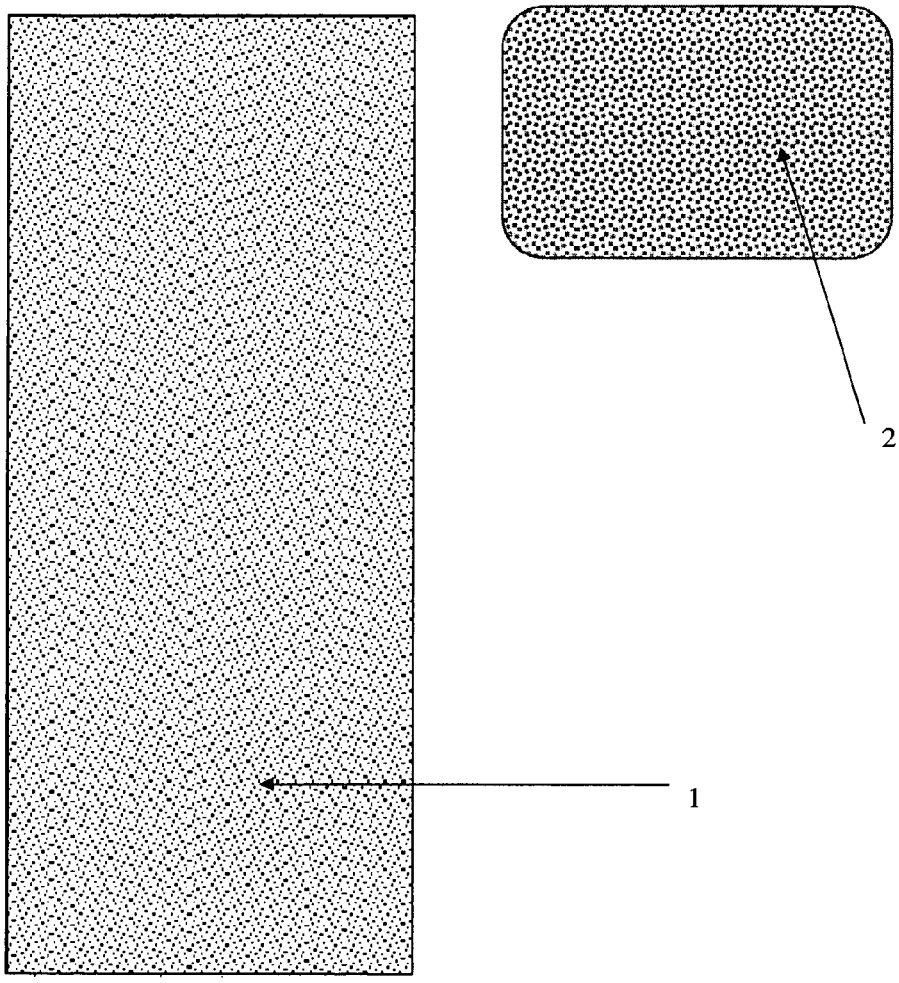
FIG. 2 is another top view of the first embodiment of a supplemental mat to the side of a traditional yoga mat.
Figure 3:
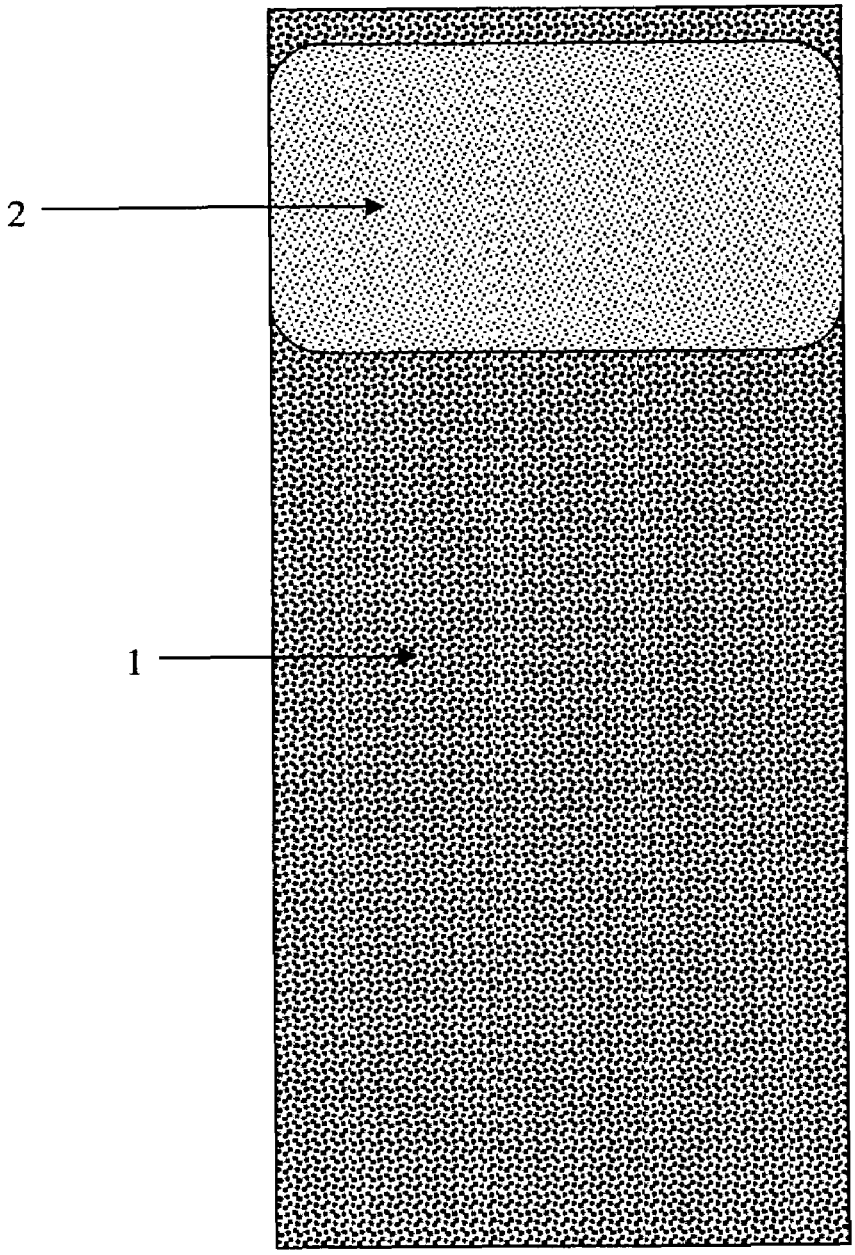
FIG. 3 is a top view of the first embodiment thereof with the supplemental mat positioned on top of the traditional yoga mat.

As illustrated in FIG. 2, an individual may place the present invention supplemental mat 2 directly to the side or, as shown in FIG. 3, at the top of the exercise mat 1 (e.g. traditional yoga mat) until a specific pose calls for her to place it in a more exact area.

In another embodiment, the supplemental mat may include a strap 3 detachable from the cushion portion. This strap 3 may be used to further assist in the execution and/or maintaining of a yoga pose. The strap 3 may further serve to secure the cushion portion to the exercise mat 1 (e.g. traditional yoga mat), thereby causing the supplemental mat 2 to also serve as a carrier for the exercise mat 1. In one embodiment, the supplemental mat includes a strap 3 which secures the cushion portion about the rolled exercise mat 1. Advantages of the present invention will now be described in detail with reference to the accompanying drawings.

Figure 4:
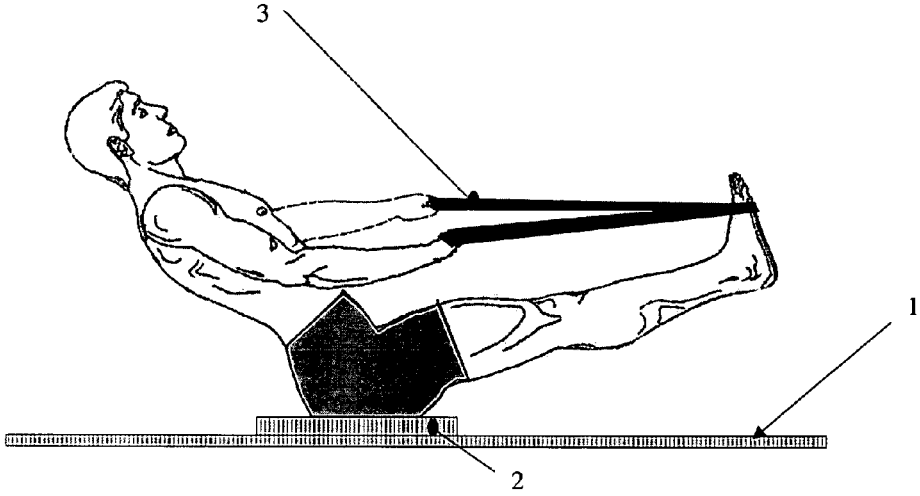
FIG. 4 is a side view of the first embodiment in use positioned on top of a traditional yoga mat with user employing the use of a strap.

FIG. 4 illustrates how the strap 3 is used in certain poses. In this example, the strap 3 is used for a Boat pose; however, the strap 3 may be used for many other poses as well. In the Boat pose, the individual must extend the legs to a 45-degree angle from a seated position. The strap 3 is placed around the soles of the feet. The individual then holds the two ends of the strap 3 with his hands and raises the legs. By pulling on the end of the strap 3, the individual supports the legs in the raised position. Because this position may be difficult to achieve or maintain, support may be provided through the use of the strap 3. FIG. 4 also shows the supplemental mat 2 including a cushion portion situated under the individual's buttocks for additional comfort and support.

Figure 5:
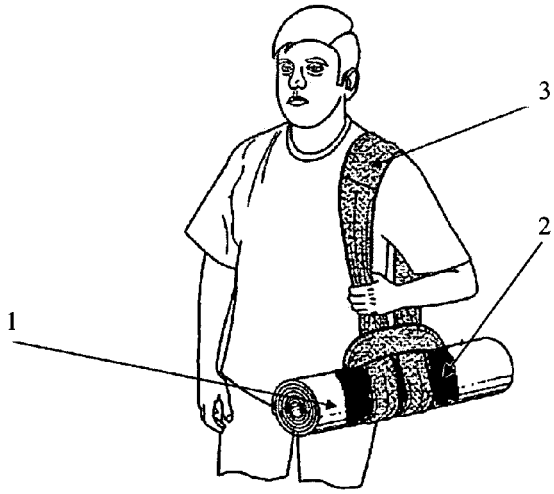
FIG. 5 is a perspective view of a strap for use with the present invention supplemental mat.

FIG. 5 illustrates an embodiment of the present invention wherein the strap 3 secures the exercise mat 1 (i.e. traditional yoga mat) to the supplemental mat 2. In FIG. 5, the exercise mat 1 is rolled, and the supplemental mat 2 is rolled about the exercise mat 1, thereby serving as a carrier for the exercise mat. As shown in this embodiment, a knot may be used to secure the exercise mat 1 (e.g. traditional yoga mat) to the supplemental mat 2. Once secured together, this three-in-one yoga kit is easily portable.

In another embodiment, FIGS. 6-8 illustrate a series of steps for arranging the strap 3 to hold the mats (1 & 2). In FIG. 6, the exercise mat 1 (i.e. traditional yoga mat) and the supplemental mat 2 are placed on the strap 3 to form two openings. The first opening 4 extends to the panel 4-end of the strap 3. The second opening 5 extends to the panel 5-end of the strap 3. In FIG. 7, the panel 4-end is guided through the opening A in the direction of arrow AR1. Once the panel 4-end passes through the opening A, the panel 4-end is pulled up in the direction of arrow AR2 as illustrated in FIG. 8. The opening A begins to close as the panel 4-end is pulled in the AR2 direction to hold the mats (1 & 2). A further opening B remains to allow the person to grab the panel 4-end of the strap 3 or place the panel 4-end around his shoulder as illustrated in FIG. 5. The present invention is not limited to the knot illustrated in FIGS. 5-8. Other knots well known to one of ordinary skill in the art can be used to hold the yoga kit, whether rolled or unrolled.

Figure 9:
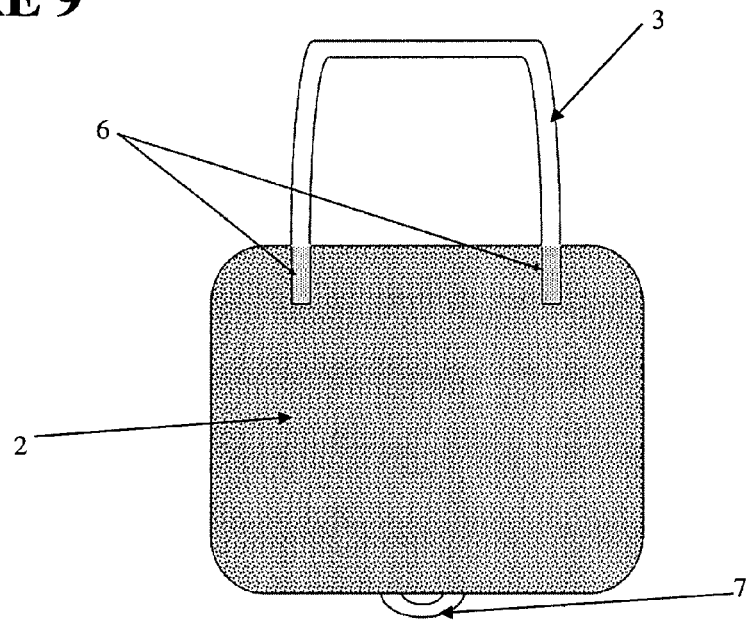
FIG. 9 is a top view of a fifth embodiment of a supplemental mat with a handle and strap which is attached via Velcro.

FIG. 9 illustrates another embodiment wherein two ends of the strap 3 are attached by Velcro strips 6 to the supplemental mat 2. A three inch loop 7 may further be attached to the other end of the supplemental mat 2. The opening of the strap 3 may then be pulled through, thereby serving as a carrier for the exercise mat.

Figure 10:
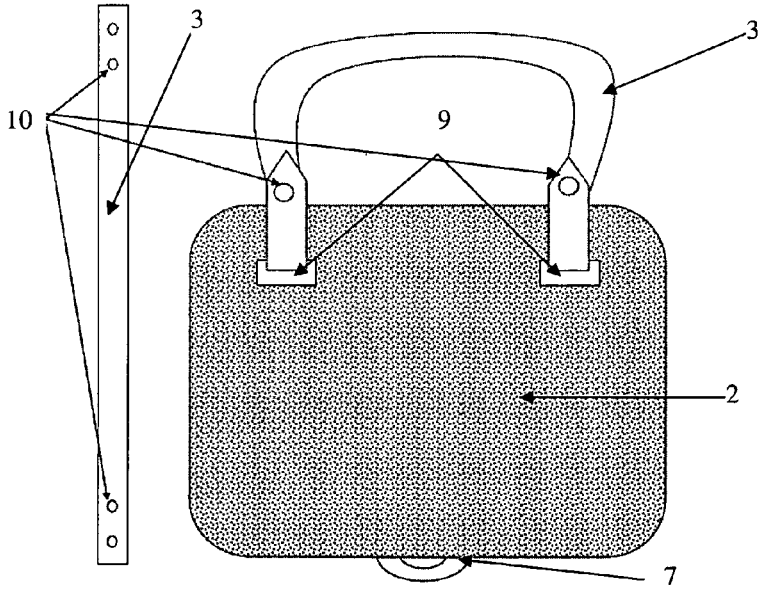
FIG. 10 is a top view of a sixth embodiment of a supplemental mat with a handle and strap which is attached via snaps.

FIG. 10 illustrates another embodiment wherein the two ends of the strap 3 are attached to the supplemental mat 2 through two and half inch reinforced horizontal slits 9 approximately one and three quarter inches from the top of the supplemental mat 2 and approximately four inches from the outside edges of the supplemental mat 2 and a three inch loop 7 can be attached to other end of the supplemental mat 2. The two ends of the strap 3 are further secured by snaps 10 approximately a half an inch in circumference placed one inch and seven and one half inches from both ends of strap 3.

Figure 11:
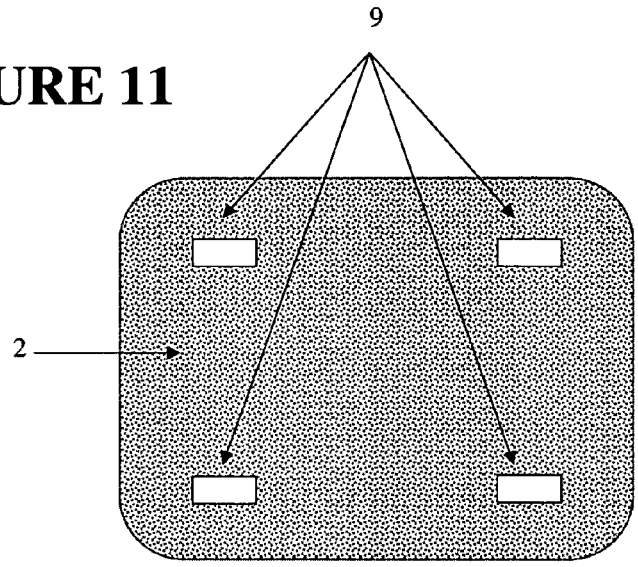
FIG. 11 is a top view of a seventh embodiment of a supplemental mat with slits in each of the four corners.
Figure 11A:
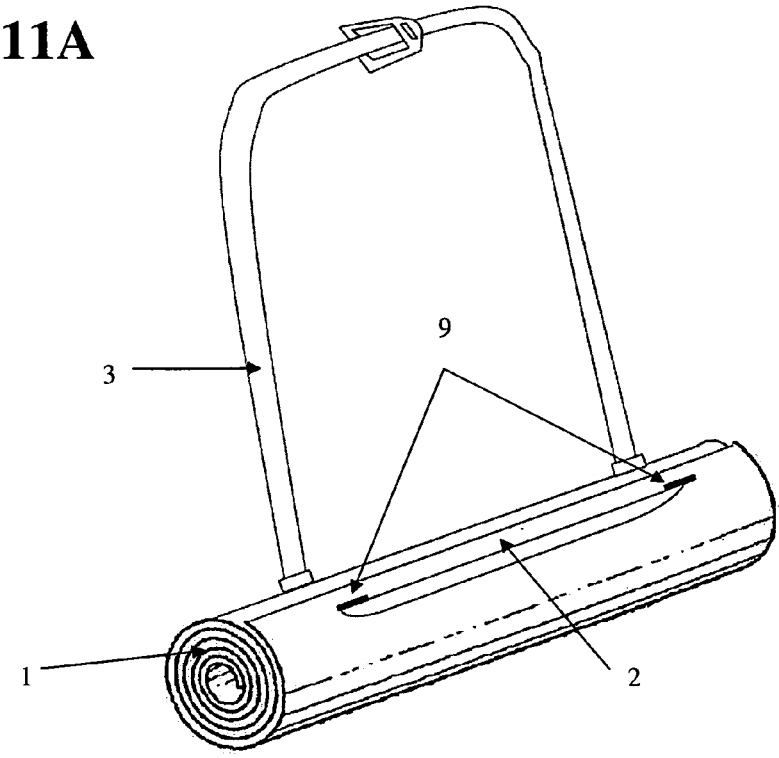
FIG. 11A is a perspective view of the sixth embodiment in a rolled up position secured by a strap.

As shown in FIG. 11A, the strap 3 may be threaded through the top and bottom of the supplemental mat 2 thereby creating a carrier wherein the strap 3 secures the supplemental mat about the exercise mat. In one embodiment, two ends of the strap 3 can be secured by the buckle on the strap 3. When the strap 3 is detached from the supplemental mat 2, it may be used to further assist in the execution and/or maintaining of a select body position in one's yoga/exercise practice.

The present invention has been described in accordance with the embodiments shown, and one of ordinary skill in the art will readily recognize that there could be variations to the embodiments, and any variations would be within the spirit and scope of the present invention. Accordingly, many modifications may be made by one of ordinary skill in the art without departing from the spirit and scope of the appended claims.

What is claimed is:

1. A three-in-one yoga kit comprising an exercise mat adapted to support substantially the whole body of a user, a supplemental mat substantially smaller in size than the exercise mat adapted to be rolled about the exercise mat to form a carrying apparatus, the supplemental mat further defining apertures for receiving a strap for securing the supplemental mat about said exercise mat, and a strap of sufficient length to be releasably positionable on a shoulder of a user and adapted to secure the supplemental mat about the exercise mat and further adapted for use as a handle positionable over a shoulder of a user for carrying said kit, wherein said strap can be detached to be used as an assist in one's yoga or exercise practice.

2. The kit of claim 1 wherein said strap further assists in execution and/or maintaining of a select body position.

3. The kit of claim 1 wherein the supplemental mat includes a pocket.

4. The supplemental kit of claim 1 wherein the supplemental mat is approximately one quarter the size of the exercise mat.

5. The kit of claim 1 wherein the supplemental mat is constructed of a flexible, wear-resistant material.

6. The kit of claim 1 wherein the exercise mat is rolled and the strap secures the supplemental mat about the rolled exercise mat.

7. The kit of claim 1 wherein the cushion portion is thicker than the exercise mat.

8. The kit of claim 1 comprising a base which is composed of a gripping surface that prevents said mat from sliding on any surface on which it is placed.

9. The three-in-one yoga kit of claim 1, wherein said exercise mat is a yoga mat.

10. The three-in-one yoga kit of claim 1 wherein said strap is be made from cloth, nylon, synthetics, or cotton.

* * * * *